US005816831A

United States Patent [19]

Clark

[11] Patent Number: 5,816,831

[45] Date of Patent: Oct. 6, 1998

[54] MULTIPLE ROW SURFACE MOUNT CONNECTOR

[75] Inventor: Stephen L. Clark, Dillsburg, Pa.

[73] Assignee: Berg Technology, Inc., Reno, Nev.

[21] Appl. No.: 774,443

[22] Filed: Dec. 30, 1996

[51] Int. Cl.[6] ..... H01R 13/73

[52] U.S. Cl. ..... 439/79; 439/570; 439/541.5

[58] Field of Search ..... 439/571, 79, 540.1, 439/67, 569, 570, 541.5

[56] References Cited

U.S. PATENT DOCUMENTS 5,044,984 9/1991 Mosser et al. ..... 439/541.5
5,316,488 5/1994 Gardner et al. ..... 439/541.5

*Primary Examiner*—Gary F. Paumen
*Attorney, Agent, or Firm*—Daniel J. Long; M. Richard Page

[57] ABSTRACT

Disclosed is an assembly for mounting electrical connectors on an edge of a printed circuit board (PCB). A first elongated connector element having opposed first and second ends is positioned on the one major side of the PCB adjacent the edge. A second elongated connector element having opposed first and second ends and positioned on the other major side of the PCB adjacent the edge of the PCB in side by side relation with said first elongated connector. A single fastener simultaneously engages both elongated connector elements and the PCB. The fastener may be a pair of blocks which each have a rear groove and ledge combination to engage the PCB and side tongue and groove combinations to engage the connector elements.

17 Claims, 7 Drawing Sheets

MULTIPLE ROW SURFACE MOUNT CONNECTOR

BACKGROUND OF THE INVENTION

1. Field of the Invention

The present invention relates to electrical connectors and more particularly to electrical connectors adapted to be mounted on the edge of a printed circuit board (PCB).

2. Brief Description of Prior Developments

Various systems have been used to mate electrical connectors to printed circuit boards or other circuit bearing substrates. In the general case, the connector includes receptacles having pin-like "tail" portions of selected length that are designed to be electrically connected with conductive pads or traces on the printed circuit board. The tail portions can extend linearly from the connectors that is, along a line co-incident with its receptacle or at an angle relative to its receptacle. Where the connector is mounted on one of the flat sides of the circuit board, the tail portions pass through respective holes in the circuit board and are soldered to conductive pads on the opposite side of the circuit board. Since the connector is mounted on the flat surface of the circuit board, the number of conductive pads on the circuit board can readily match the number of tail portions of the connector. The soldering of the tail portions effects electrical connection and, in many cases, provides an adequate mechanical connection to affix the connector to the circuit board. Where necessary, mechanical fasteners, including threaded fasteners, clamps, brackets, frames, and the like, can be used to assist in effecting the mechanical attachment. The requirements for an edge-mounted connector are somewhat different in that the surface area available at the edge of the circuit board represents a constraint on the total number of circuit board traces and pads that can be provided for interconnection with the connector. The surface-area limitation is exacerbated where the edge-mounted connector is of the multi-row type, that is, parallel rows of pins or receptacles that form a matrix of interconnects.

A need, therefore, exists for a means for increasing density in an edge-mounted connector.

SUMMARY OF THE INVENTION

The present invention is an assembly for mounting electrical connectors on an edge of a PCB. The assembly includes a first elongated connector element having opposed first and second ends. This first elongated connector is positioned on the first major side of the PCB adjacent the edge of the PCB. A second elongated connector element having opposed first and second ends is positioned on the second major side of the PCB adjacent the edge of the PCB in side by side relation with said first elongated connector member. A least the first end of the second elongated connector element is positioned in adjacent to said first end of the first elongated connector element. A fastening means is fixed to the first and second elongated connector element and the PCB so as to fix the first and second elongated connector elements to the PCB. Preferably the fastening means are fixed to both the first and second ends of both of the connector elements.

Also encompassed by the present invention is a fastener for use in fixing a pair of elongated electrical connector elements in parallel superimposed relation to an edge of a PCB. The fastener comprises of block having opposed front and rear sides and inward and outward lateral sides. There is a groove for receiving the PCB on the rear side, and a ledge projects from the rear side adjacent this groove in side by side relation to the PCB. On the inner lateral side there are means for attaching the block to the ends of the elongated connector elements.

BRIEF DESCRIPTION OF THE DRAWINGS

The connector assembly of the present invention is further described with reference to the accompanying drawings in which.

DETAILED DESCRIPTION OF THE PREFERRED EMBODIMENTS

Figure 1:
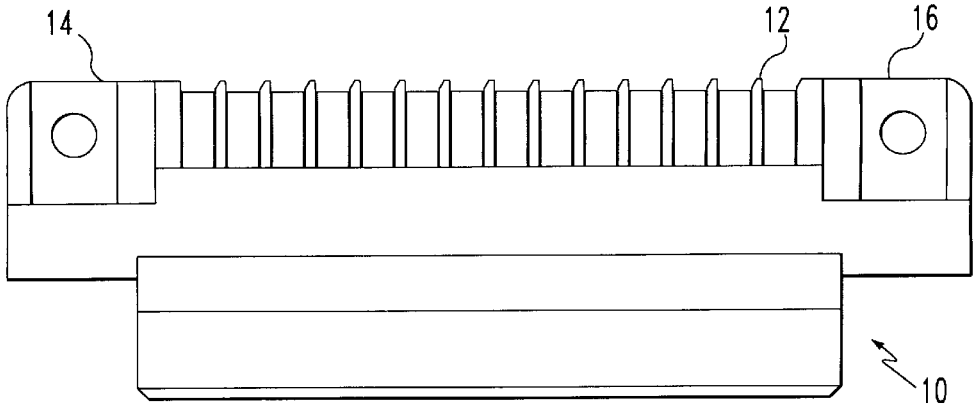
FIG. 1 PRIOR ART
FIG. 1 is a top plan view of a prior art right angle receptacle adapted to be mounted on the surface of a PCB.
Figure 2:
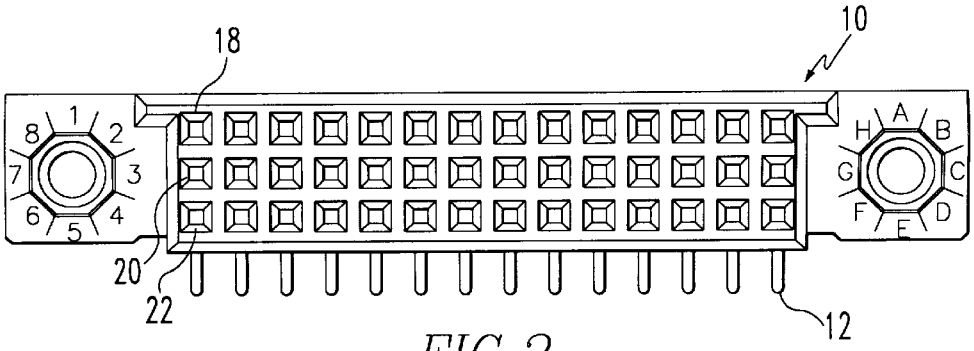
FIG. 2 PRIOR ART
FIG. 2 is a front view of the right angle receptacle shown in FIG. 1.
Figure 3:
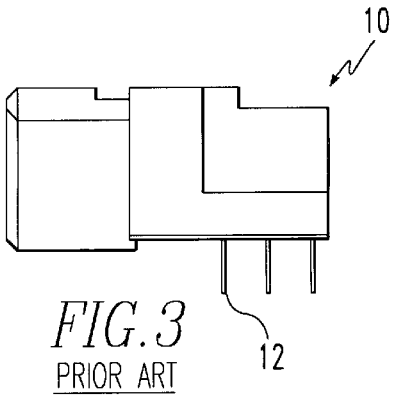
FIG. 3 PRIOR ART
FIG. 3 is an end view of the right angle receptacle shown in FIG. 1.

Referring to FIGS. 1–3, a prior art three-row right angle receptacle is shown. The dielective housing, shown generally at numeral 10 supports a plurality of right angle contacts as at contact 12. Mounting brackets 14 and 16 are provided to fix the receptacle on a PCB. On its front face the receptacle has three rows of apertures 18–20 and 22 in which contacts are engaged by an accompanying header (not shown).

Figure 4:
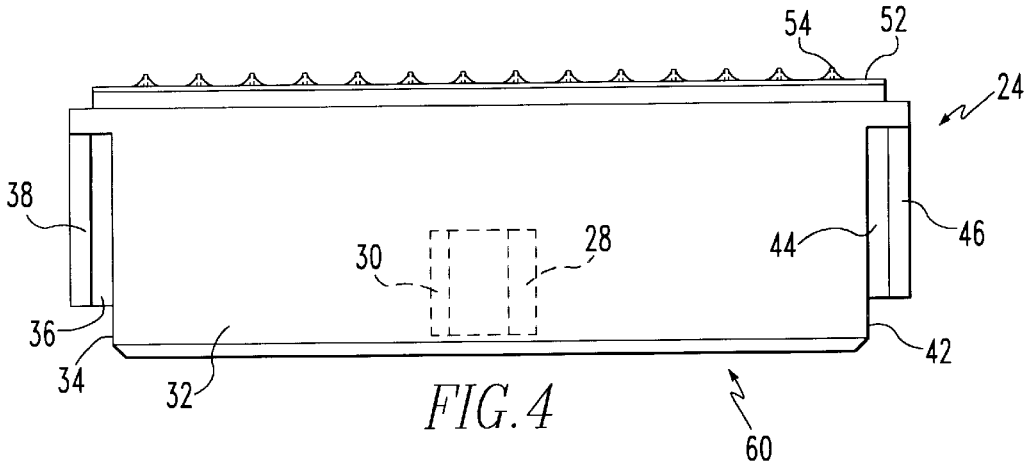
FIG. 4 is a top plan view of one of the two receptacles used in the preferred embodiment of the assembly of the present invention.
Figure 5:
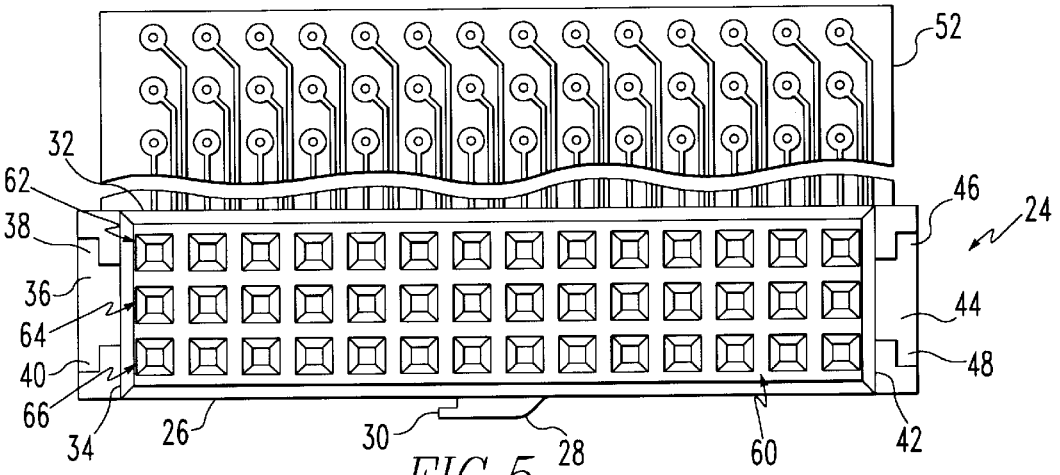
FIG. 5 is a front view of the receptacle shown in FIG. 4.
Figure 6:
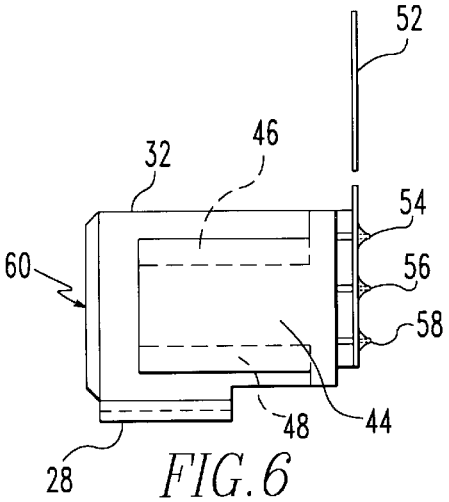
FIG. 6 is an end view of the receptacle shown in FIG. 4.
Figure 7:
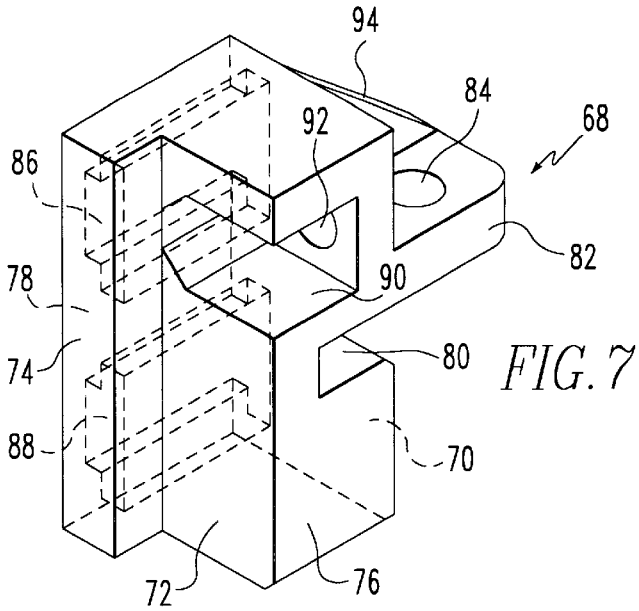
FIG. 7 is a perspective view of the fastener block member used in the assembly of the present invention.
Figure 8:
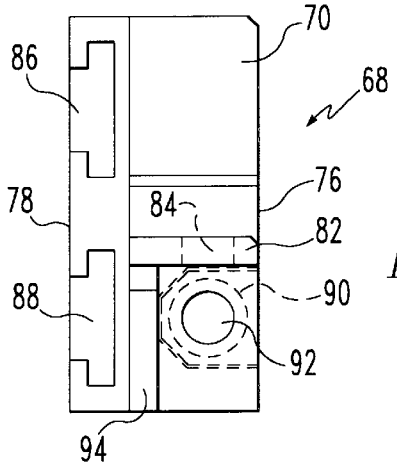
FIG. 8 is a rear elevational view of the fastener block shown in FIG. 7.
Figure 9:
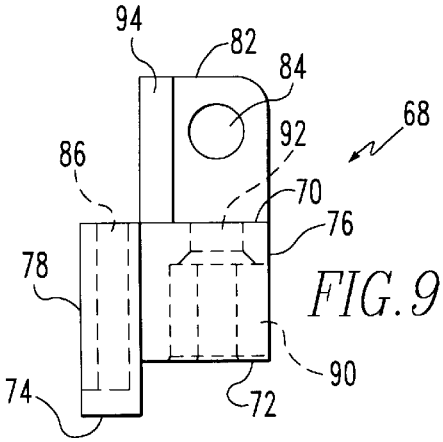
FIG. 9 is a top plan view of the fastener block shown in FIG. 7.
Figure 12:
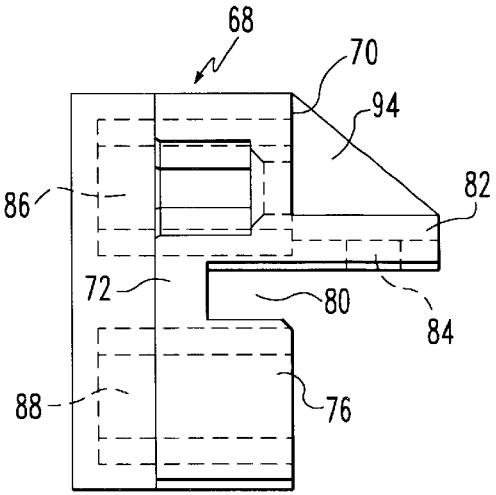
FIG. 12 is an outer side view of the fastener block shown in FIG. 7.
Figure 10:
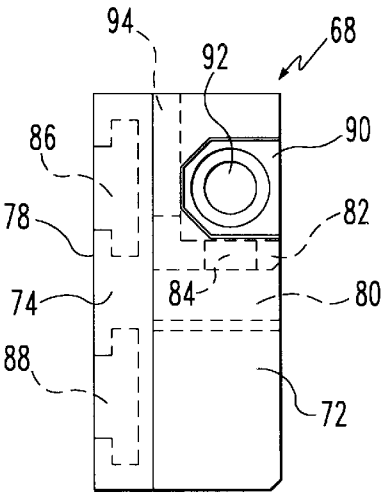
FIG. 10 is a front elevational view of the fastener block shown in FIG. 7.
Figure 11:
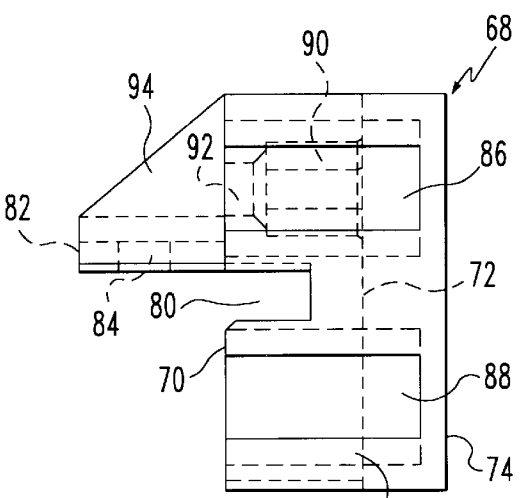
FIG. 11 is an inner-side view of the fastener block shown in FIG. 7.

Referring to FIG. 4–6, a receptacle which may be used in a preferred embodiment of the present invention is shown generally at numeral 24. This receptacle has a base 26 with a downward extending projection 28 having a lateral extension 30 which is used to engage another receptacle as is explained below. Receptacle also has a top 32 and an end 34 from which a tongue 36 having lateral projections 38 and 40 extends. On the opposite side of the housing is another end 42 with a tongue 44 also having lateral projections 46 and 48. The receptacle also has a rear side 50 where it is attached to a flexible circuit 52 by means, for example, of terminals 54, 56 and 58. The receptacle has a front face 60 with a three rows 62, 64 and 66 of apertures which contain terminals which may be engaged by pins on a header.

Referring to FIGS. 7–12, a fastening block which, as is explained below, is mounted at each end of the receptacle is shown generally at number 68. This block has rear side 70 and a front side 72 on which there is mounted a vertical front ridge 74. The fastener block also has an outer lateral side 76 and an inner lateral side 78. On the rear side there is a PCB receiving slot 80 and an adjacent rearwardly extending ledge 82 which has a transverse fastener receiving ledge aperture 84. On the inner lateral side 78 there is an upper T-shaped groove 86 and a lower T-shaped groove 88. These grooves extend from the rear side forward and are spaced from the front side 72, that is, they do not reach the front side 72. From the front side 72 there is also a front recess 90 and an aperture 92 which extends through to the rear side 90 to enable, as will be explained below, the fastener block to be fixed to the PCB by means of a fastener (not shown). There is also a triangularly shaped support 94 which extends from the rear side 72 the ledge 82 adjacent the inner lateral side 78.

Figure 14:
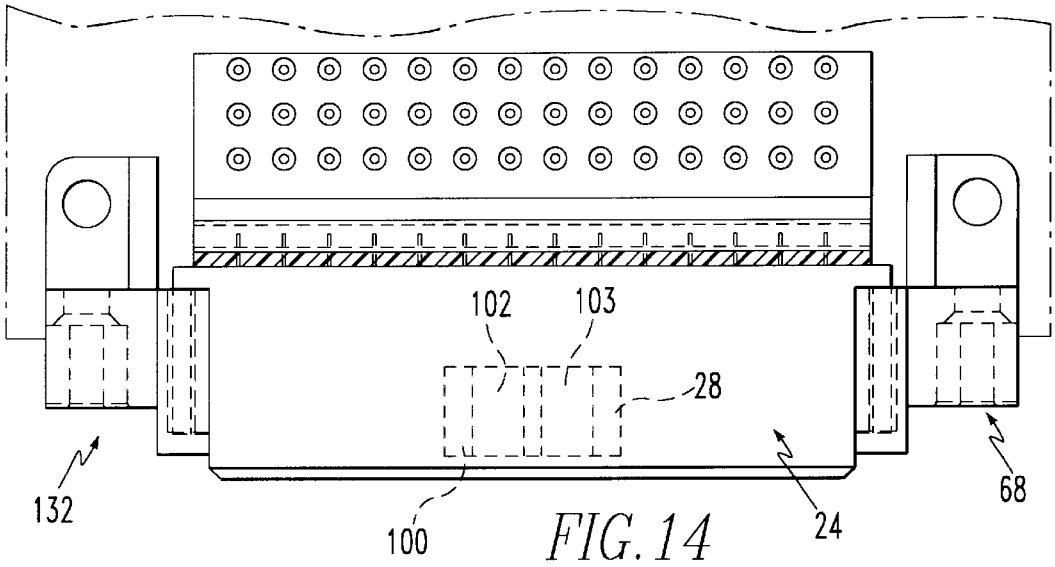
FIG. 14 is a front elevational view of the assembly shown in FIG. 14.
Figure 13:
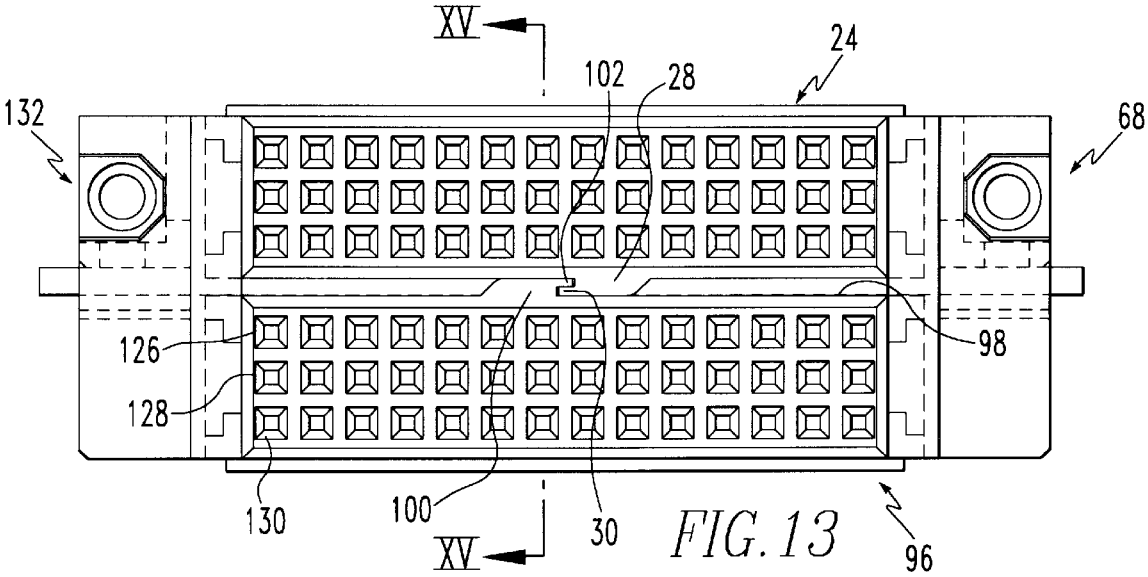
FIG. 13 is a top plan view of a preferred embodiment of the assembly of the present invention.
Figure 15:
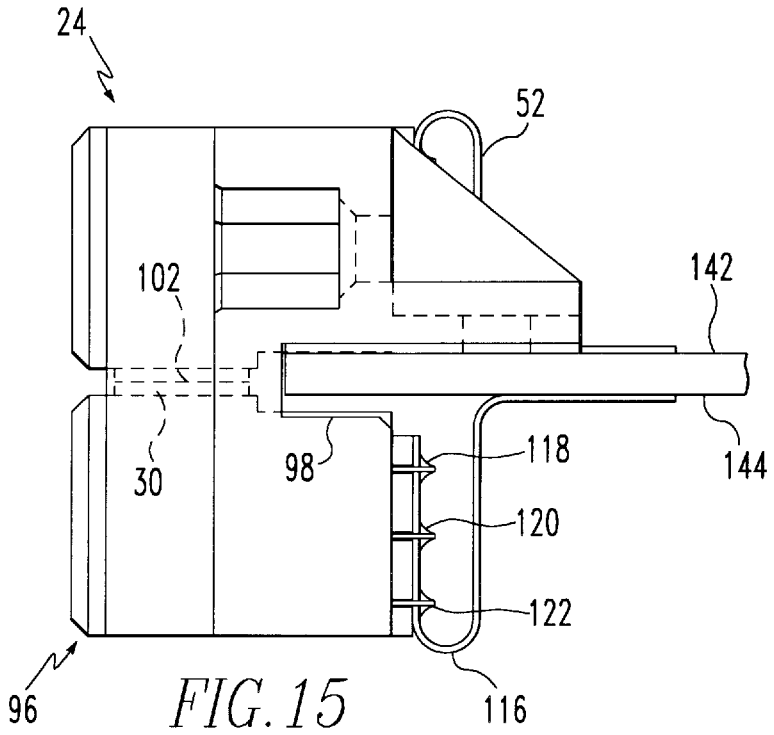
FIG. 15 is an end view of the assembly shown in FIG. 13.

Referring to FIGS. 13–15, It will be seen that the receptacle 24 is engaged with another receptacle shown generally at 96 to double the number of available rows of terminals in the combined assembly. The receptacle 96 is essentially the mirror image of receptacle 24 and includes a base 98 which has a projection 100 having a lateral extension 102 that engages the projection 28 and lateral extension 30 of receptacle 24. Like receptacle 24, receptacle 96 also has a top side one of 104 and an end 106 having a tongue 108 with an opposed end 110 also having a tongue 112. The receptacle 96 also includes terminals as, for example, terminals 118, 120, and 122 (FIG. 15). Although obscured by support 94, in FIG. 15, it will be understood that receptacle 24 has similar terminals. On the front face 124 of the receptacle there are three rows of apertures 126, 128, and 130 which contain a pin receiving terminals as will be explained in greater detail hereafter. At their opposed ends the receptacles 24 and 96 are fixed to fastener blocks 68 and 132. It will be understood that fastener block 132 is essentially a mirror image of fastener block 68. It will also be understood that the fastener blocks 68 and 132 will desirably be configured so that they will snap onto the receptacles so that when the projections at 28 and 100 of receptacles 24 and 96 are engaged to provide an integral a one piece connector having six rows. It will be understood that the assembly of the present invention of the present invention may also be adapted for use with receptacles having other numbers of rows. In particular, this assembly may be particularly useful with receptacles having four rows to produce a composite assembly having 8 rows.

Figure 16:
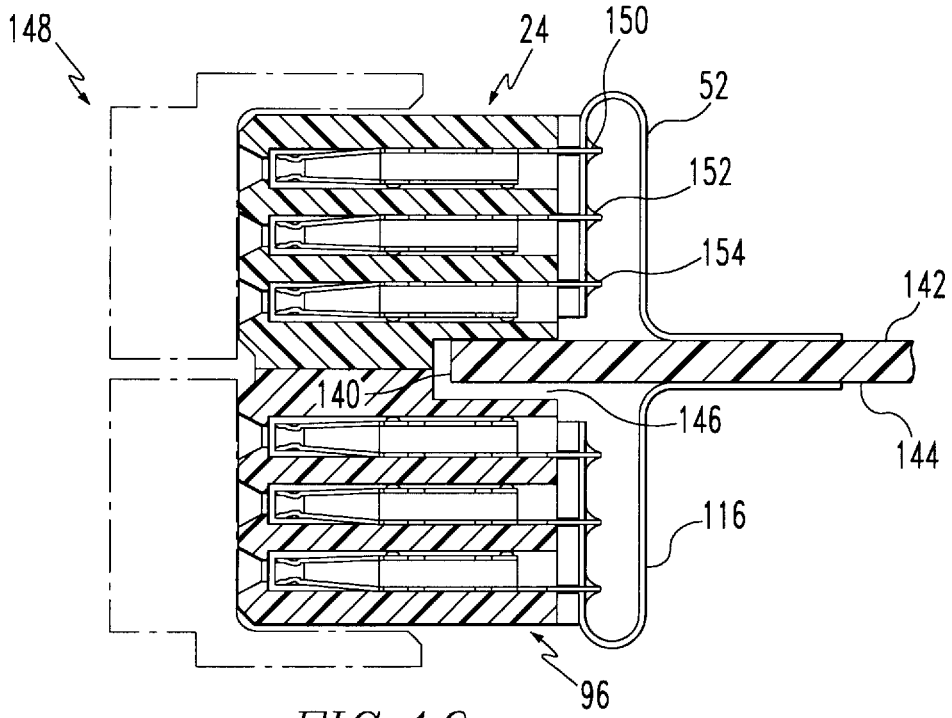
FIG. 16 is a cross-sectional view through XVI in FIG. 14.

Referring to FIGS. 13–16, it will be seen that the PCB has a front edge 140 and opposed sides 142 and 144. The edge 140 is positioned in a groove 146 between the receptacle 24 and the receptacle 96. The flexible circuit 52 extends from the receptacle 24 to the top side 142 of the PCB. The flexible circuit 116 extends from the receptacle 96 to the bottom side 144 of the PCB. The back panel pin header housing is shown in phantom lines at numeral 148 (FIG. 16). Pins (not shown) in this housing engage contacts as at contact 150, 152 and 154. It will be understood that receptacle 96 has similar terminals that engage flexible circuit 116 and are engaged by pins (not shown) in the back panel pin header housing 148 (FIG. 16).

Figure 17:
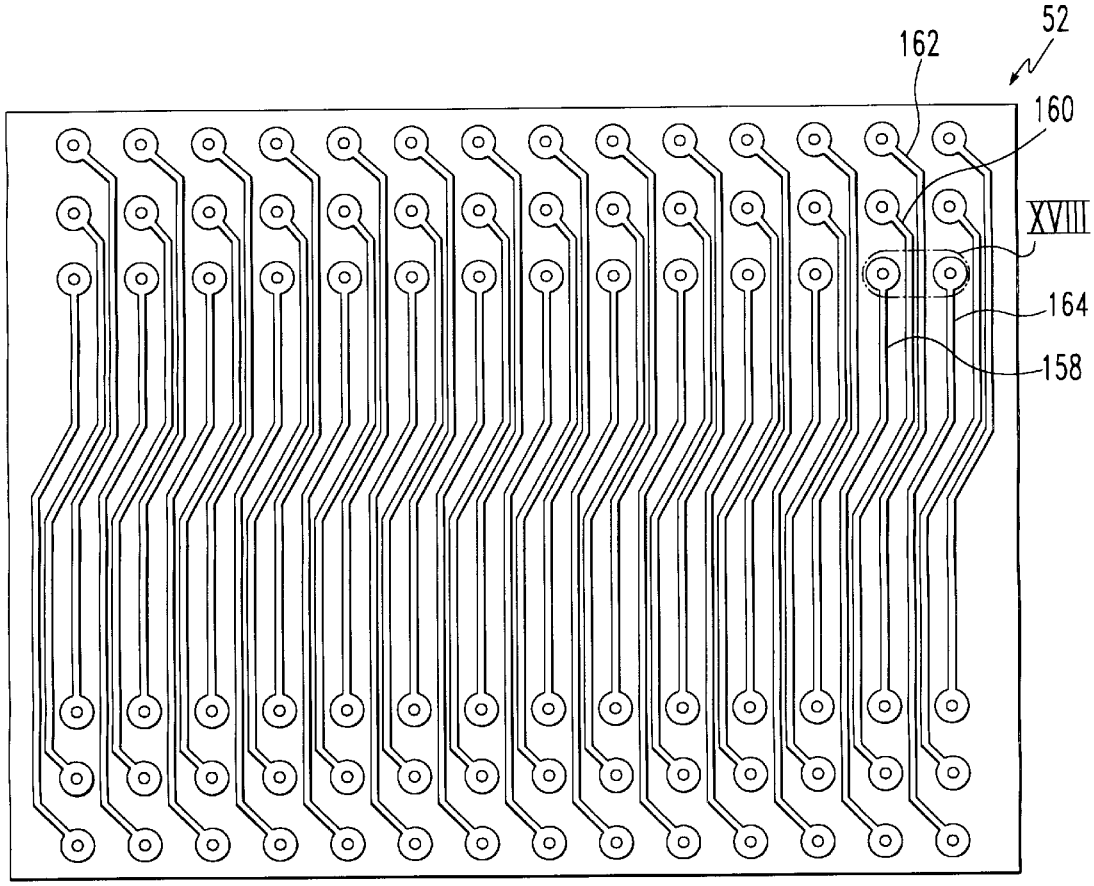
FIG. 17 is a detailed view of the flex circuit shown in various figures above.
Figure 18:
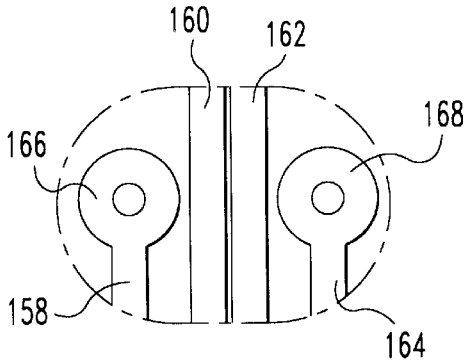
FIG. 18 is a detailed view of area XVIII in FIG. 17.

Referring to FIG. 17–18, it will be seen that the flexible circuit 52 is comprised of laminated polyimide layers with a number of conductive traces of equal length as traces 158, 160, 162 and 164. Those conductive traces connect conductive pads as at pads 166 and 168 (FIG. 18) where the flexible circuit would be connected to a receptacle or a PCB. It will be understood that flexible circuit 116 is essentially identical to flexible circuit 52. Such flexible circuits are described in somewhat greater detail in U.S. Pat. No. 4,861,272 to Clark, the contents of which are incorporated herein by reference.

It will be appreciated that an assembly has been described by which receptacles are mounted on the edge of a circuit board in a way to increase the number of available terminals and therefore density.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector assembly comprising:

(a) a first elongated electrical connector element having opposed first and second ends and positioned on a first major side of a PCB overlapping an edge of the PCB;

(b) a second elongated electrical connector element having opposed first and second ends and positioned on a second major side of the PCB overlapping the edge of the PCB in side by side relation with said first elongated connector element such that at least said first end of the second elongated connector element is positioned adjacent to said first end of the first elongated connector element; and (c) a single fastening means engaging the first connector element, the second connector element and the PCB.

2. The assembly of claim 1 wherein the fastening means includes a first fastener member which is fixed to the PCB and is fixed to the first connector element adjacent its first end and is fixed to the second connector element adjacent its first end.

3. The assembly of claim 2 wherein the means fastening includes a second fastener member which is fixed to the PCB and is fixed to the first connector element adjacent its second end.

4. The assembly of claim 1 wherein the first and second connector elements each have at least one row of terminals parallel to the PCB.

5. The assembly of claim 4 wherein both the first and second connector elements have a plurality of parallel rows of terminals.

6. The assembly of claim 5 wherein both the first and second connector elements have three rows of terminals.

7. The assembly of claim 5 wherein the first and second connector elements each have 4 rows of terminals.

8. The assembly of claim 5 wherein the first connector element is a receptacle.

9. The assembly of claim 2 wherein the first fastener member is fixed to the first end of both the first and second connector elements.

10. The assembly of claim 9 wherein the first fastener member is comprised of a block having opposed front and rear sides and opposed inward and outward lateral sides and on the rear side there is a groove for receiving the PCB and a ledge projects rearwardly adjacent said groove in side-byside relation with the PCB and has thereon means for fixing the PCB to said block, and on the inner lateral side said block abuts the first end of the PCB and has thereon a means for fixing said block to said first end of both the first and second elongated connector element.

11. The assembly of claim 10 wherein said assembly includes a means for fixing the fastening block to the first end of the first and second elongated connector element.

12. The assembly of claim 10 wherein a fastener receiving aperture extends transversally through the ledge.

13. The assembly of claim 10 wherein a diagonal support extends from the rear side of the block to the ledge adjacent the inner side of the block.

14. The assembly of claim 2 wherein the first and second elongated connector elements each have a base side superimposed on the PCB, a front side facing away from the PCB and a rear side facing toward the PCB, and a flexible circuit extends from the rear sides of said first and second elongated connector element respectively to said first and second major sides of the PCB.

15. An assembly for mounting electrical connectors on an edge of a printed circuit board (PCB) having opposed first and second major sides comprising:

(a) a first elongated connector element having opposed first and second ends and positioned on the first major side of the PCB adjacent the edge of the PCB;

(b) a second elongated connector having opposed first and second ends and positioned on the second major side of the PCB adjacent the edge of the PCB in side by side relation with said first elongated connector member such that at least said first end of the second elongated connector element is positioned adjacent to said first end of the first elongated connector element; and (c) a block having opposed front and rear sides and opposed inward and outward lateral sides and on the rear side there is a groove for receiving the PCB and a ledge projects rearwardly adjacent said groove in side by side relation with the PCB and has thereon means for fixing the PCB element said block and on the inner lateral side said block abuts the first end of the first elongated connector and the first end of the second elongated connector element and has thereon means for fixing said block to said first end of the first elongated connector element and the first end of the second elongated connector element.

16. The assembly of claim 15 wherein a second block having opposed front and rear sides and opposed inward and outward lateral sides and on the rear side there is a groove for receiving the PCB and a ledge projects rearwardly adjacent said groove in side by side relation with the PCB and has thereon means for fixing the PCB to said block, and on the inner lateral side said block abuts the second end of the first elongated connector element and the second end of the second elongated connector element and has thereon means for fixing said block to said second end of the first elongated connector element and the second end of the second elongated connector elements.

17. A fastener for use in fixing a pair of elongated electrical connector elements in parallel superimposed relation to an edge of a printed circuit board (PCB) comprising a block having opposed front and rear sides and opposed inward and outward lateral sides and on the rear side there is a groove for receiving the PCB and a ledge projects rearwardly adjacent said groove in side by side relation with the PCB and has thereon means for fixing the PCB to said block and on the inward lateral side there are means for attaching said block to the ends of the elongated electrical connector elements.

* * * * *